US005291805A

United States Patent [19]

Byers et al.

[11] Patent Number: 5,291,805

[45] Date of Patent: Mar. 8, 1994

[54] SHARPENING AND DEBURRING TOOL

[76] Inventors: Gary L. Byers; Timothy W. Byers, P.O. Box 550, Whitefish, Mont. 59937

[21] Appl. No.: 908,420

[22] Filed: Jul. 6, 1992

[51] Int. Cl.[5] ..... B24D 15/06

[52] U.S. Cl. ..... 76/88; 76/82.2; 76/DIG. 11

[58] Field of Search ..... 76/82, 82.2, 86, 88, 76/DIG. 11; 51/214, 204, 205, 205 WG

[56] References Cited

U.S. PATENT DOCUMENTS 4,418,588 12/1983 Byers ..... 76/88

FOREIGN PATENT DOCUMENTS 2519205 11/1976 Fed. Rep. of Germany ..... 76/82
0198473 6/1938 Switzerland ..... 76/82
0010843 of 1908 United Kingdom ..... 76/86
0652581 4/1951 United Kingdom ..... 76/86

*Primary Examiner*—Roscoe V. Parker
*Attorney, Agent, or Firm*—Harry M. Cross, Jr.

[57] ABSTRACT

A hand held sharpening and deburring tool is disclosed which is capable of sharpening a variety of bladed implements such as knives, hatchets, scissors, cleavers, garden trowels and etc. The tool comprises a body having a handle grip section, a sharpening/deburring section and a transition section that melds the grip and sharpening/deburring sections together and also mounts a guard for protecting the operator's hand from injury. The sharpening/deburring section including a first transversely mounted sharpening/deburring insert extending to one side of the body for sharpening or deburring a scissors blade or like device, said sharpening/deburring section also including second and third sharpening/deburring inserts defining a V-shaped notch which extends toward the tip of the body for sharpening or deburring the cutting edge of a knife or like device.

8 Claims, 2 Drawing Sheets

FIG. 1
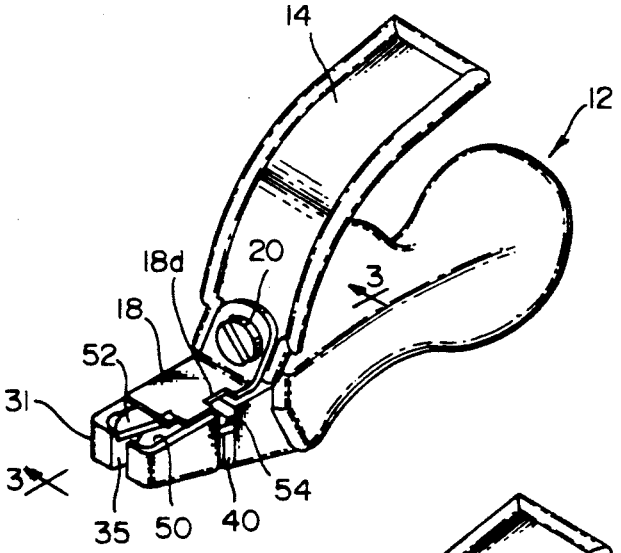
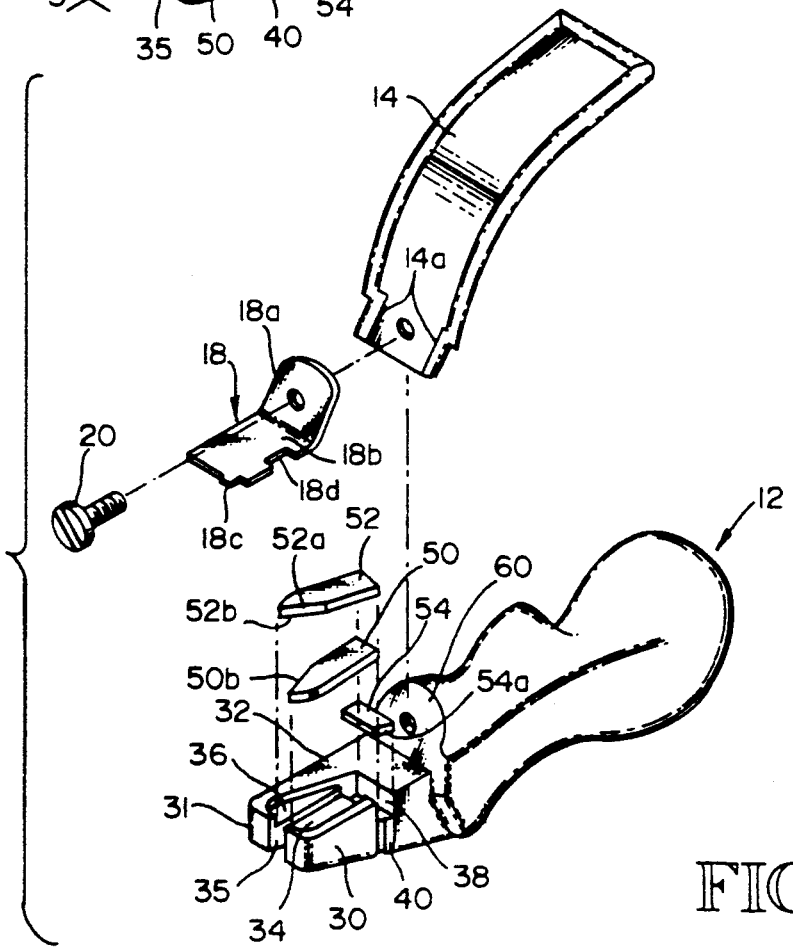
FIG. 2

SHARPENING AND DEBURRING TOOL

FIELD OF THE INVENTION

This invention relates to hand tools and, more particularly, to hand held sharpening and deburring tools.

BACKGROUND OF THE INVENTION

Hand held sharpening and deburring tools have been proposed for home, business, sports, commercial and industrial uses. Hand held tools of this type must be convenient and safe to use. They must be capable of sharpening or deburring a variety of bladed implements such as knives, hatchets, cleavers, scrapers, arrowheads and scissors, as well as implements having blade-like edges such as garden trowels and other gardening tools. Although hand held tools of this type have been proposed that can accommodate like-structured devices, such as knife-type blades where sharpening or deburring must occur on two convergent surfaces, or such as scissors-type blades where sharpening or deburring must occur on only one surface, such tools have not successfully accommodated the sharpening or deburring of both types of the aforementioned devices.

SUMMARY OF THE INVENTION

A tool comprises a body having recesses in a first frontal section thereof to receive sharpening and/or deburring inserts and a second section located longitudinally rearwardly of the first frontal section. The recesses are adapted to receive a first insert member in a generally lateral position with respect to the longitudinal axis of the body that extends transversely to one of the sides of the body, and to receive a second insert member in a generally longitudinal position with respect to the longitudinal axis of the body that extends toward a front edge of the first frontal section, and to receive a third insert member in a generally longitudinal position respect to the longitudinal axis of the body that extends toward the front edge of the first frontal section. A plurality of sharpening and/or deburring insert members are positioned within the body recesses. These insert members comprise a first insert member having a ground surface providing at least one sharpening and/or deburring edge, that is positioned within the body recesses such that its ground surface is exposed at one side of the body; a second insert member, having a ground surface providing at least one sharpening and/or deburring edge, that is positioned within the body recesses such that it partially overlays the first insert member in abutting contact therewith and such that its ground surface is oriented toward the outer end of the frontal section at an acute angle with respect to the longitudinal axis of the body; and a third insert member, having a ground surface providing at least one sharpening and/or deburring edge, that is positioned within the body recesses such that it partially overlays the second insert member in abutting contact therewith and such that its ground surface is oriented at an acute angle with respect to the longitudinal axis of the body. The ground surfaces of the second and third insert members are convergent whereby an object to be sharpened or deburred may be inserted between the convergent ground surfaces for sharpening and/or deburring. The body frontal section recesses and the second and third insert members are so constructed and arranged whereby the body frontal section front edge contains a notch therein that exposes a portion of the convergent ground surfaces of the second and third insert members. The body frontal section also extends across the front ends of the second and third insert members whereby the front edge of said the frontal section provides a shield limiting sharpening and/or deburring access thereto to the notch. Insert retaining means are detachably secured to the body and are adapted to contact the third insert member and to apply a sufficient force to that insert member whereby the first, second and third insert members are restrained from movement within said body recesses.

It is an object of this invention to provide a hand held tool for sharpening or deburring devices such as (1) a knife, which has a cutting edge formed of two converging surfaces both of which must be sharpened or deburred to properly maintain the cutting edge, and (2) a scissors blade, which has a cutting edge formed of two converging surfaces only one of which must be sharpened or deburred to properly maintain the cutting edge. It is a further object to provide such a tool wherein the sharpening or deburring members may be removed and replaced or resharpened. It is a still further object to provide such a tool with means to protect the hand of the user from inadvertently contacting the tool's sharpening/deburring members or the blade of the device being sharpened/deburred.

BRIEF DESCRIPTION OF THE DRAWINGS

FIG. 1 is a perspective view of the hand held sharpener/deburrer of this invention, arranged upside down from its normal operating attitude for the sake of illustration herein;

FIG. 2 is a blown-apart view, in perspective, of the FIG. 1 tool;

DETAILED DESCRIPTION OF THE INVENTION

Figure 3:
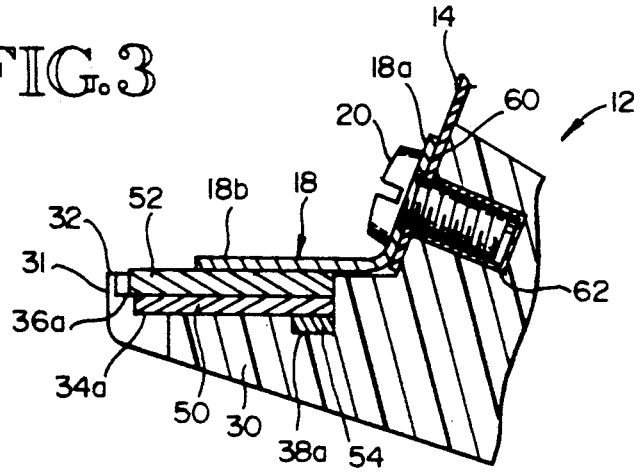
FIG. 3 is a cross-section view taken along the line 3—3 of FIG. 1.

The hand held sharpening/deburring tool 10 of this invention (see particularly FIG. 5) comprises a unitary body 12, a hand/finger guard 14, sharpening/deburring insert members 16, an insert retainer 18, and a fastening member 20. The tool body 12 comprises a handle grip section **12*a*, a sharpening/deburring insert section 12*b*, and a transition section 12*c* that melds the grip and insert sections together and also mounts the guard 14 and retainer 18 by means of the fastener 20**.

Figure 4:
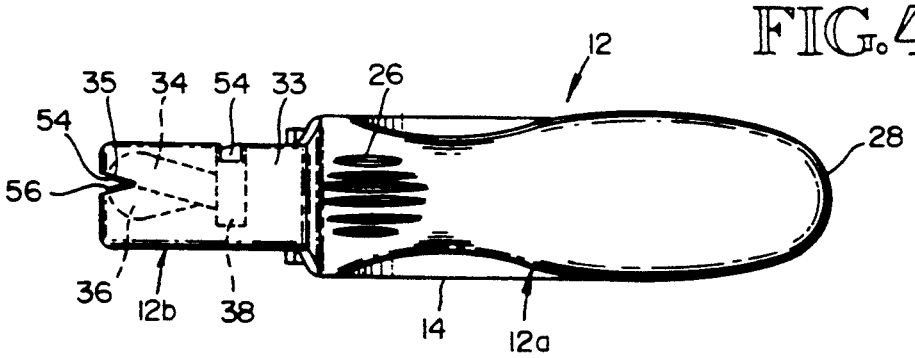
FIG. 4 is a plan view looking down on the tool of this invention it its normal working attitude (i.e. looking upward from the tool's attitude as shown in FIGS. 1, 2 and 5)

The grip section **12*a* is formed to provide appropriate contours for receiving an operator's index finger in a depression 22 and middle finger in a depression 24 and thumb in a depression 26. The rear end 28 of the grip section 12*a* is rounded to provide a resting or bracing place for an operator's ring finger. In normal use, the attitude of the tool 10 would be inverted from that shown in FIGS. 1, 2 and 5, so that the thumb rest/depression 26 would be on top of the tool. This attitude is shown in FIG. 4. The grip section 12*a*** is elongated sufficiently to accommodate an operator's hand as thusly described.

Figure 5:
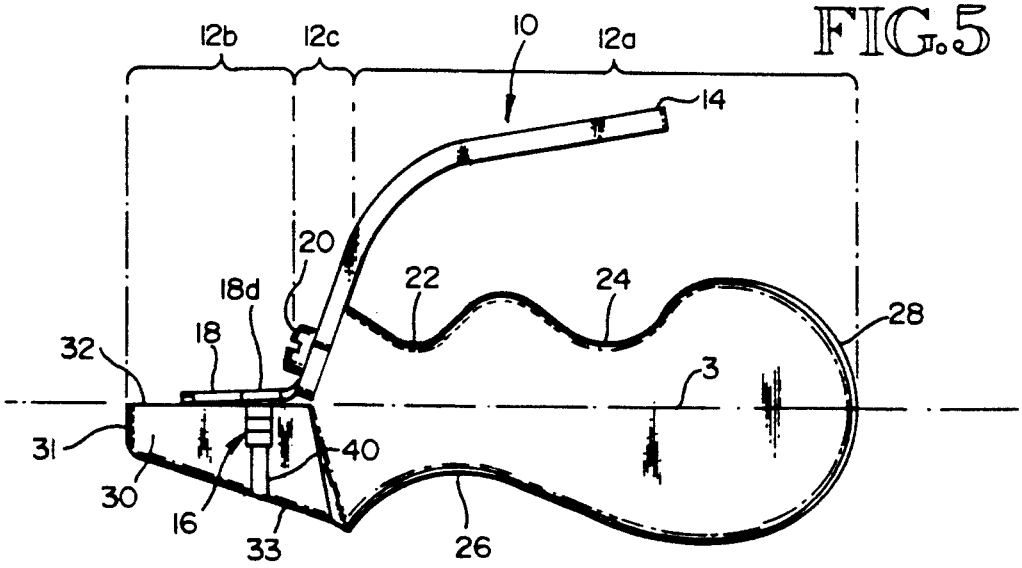
FIG. 5 is a side elevation view of the tool of this invention, arranged upside down from its normal working attitude for the sake of illustration herein.

The sharpening/deburring insert section 12b is formed to provided a forwardly-extending nose 30 having a flat surface 32 oriented generally parallel to, and coincident with, the longitudinal axis of the tool 10, as shown by the dashed line 3 in FIG. 5. As shown in FIG. 2, the nose 30 is provided with recesses within which sharpening/deburring inserts 16 are positioned. A recess 34 provides an elongated trough within which an elongated sharpening/deburring insert 50 is positioned. This recess 34 has parallel side walls that extend outwardly at an acute angle to the longitudinal axis of the tool 10 from the base of the nose 30 outward toward the tip 31 of the nose. The bottom surface 34a (FIGS. 2 and 3) of the trough of recess 34 is generally parallel to surface 32. Another recess 36, not as deep as recess 34, provides a wedge-shaped land 36a (FIGS. 2 and 3) on which another sharpening/deburring insert 52 is positioned. Recess 36 is superimposed on recess 34 such that land 36a is nearer the surface 32 than is bottom surface 34a. One of the recesses 34,36 angles outward toward the right and the other recess angles outward toward the left so that the inserts 50,52 will form a convergent acute angle between them, from their tips to their bases, when they are positioned within their respective recesses. The recesses 34,36 are of a length that the elongated inserts 50,52 are completely contained within the nose 30 such that the tip ends of the inserts 50,52 are shielded by the tip 31 of nose 30. The depth of the trough of recess 34 is substantially similar to the thickness of insert 50 such that insert 52 is supported, not only by land 36a, but also by the top of insert 50 as shown in FIG. 3, and the such that the two inserts are substantially parallel to one another and to surface 32. The depth of recess 36 is slightly less than the thickness of insert 52 such that the top surface of insert 52 will be slightly outward of surface 32 as shown in FIG. 3. Thus, the combined thicknesses of inserts 50,52 will be slightly greater than the combined depths of recesses 34,36 such that the top surface of insert 52 will be slightly outward of surface 32 as shown in FIG. 3. The degree of overlap of inserts 50,52 is sufficient that the force of bearing contact by insert retainer 18 on the top surface of insert 52, when transferred to insert 50, will be sufficient to hold both insert 50, as well as insert 52, in proper position. To facilitate frictional binding between the contacting surfaces of inserts 50,52, these adjacent surfaces are not polished.

A third recess 38 in nose 30 provides an elongated transverse trough within which an elongated sharpening/deburring insert 54 is positioned crosswise to the longitudinal axis of tool 10. This recess 38 has parallel side walls that extend generally perpendicularly to the longitudinal axis of the tool 10 across the base of the nose 30 outward toward the tip 31 of the nose, with the recess 38 opening outward to one side of the nose 30 as shown in FIGS. 1, 4 and 5). The bottom surface 38a (FIGS. 2 and 3) of the trough of recess 38 is generally parallel to surface 32. The depth of the trough of recess 38 is substantially the same as the thickness of insert 54 such that the rear end portion of insert 50 sets upon, and is supported by, the top surface of insert 54 as shown in FIG. 3. The width of recess 38 is substantially the same as the width of insert 54 such that insert 54 will fit snugly within recess 38 as shown in FIG. 3. The area of contact between inserts 50 and 54 is sufficient that the force of bearing contact by insert retainer 18 on the top surface of insert 52, when transferred to insert 54, will hold insert 54 in proper position. To facilitate frictional binding between the contacting surfaces of inserts 50,54, these adjacent surfaces are not polished.

The side 33 of nose 30 to which recess 38 opens is slotted, from the bottom surface 38a outward to the side 33 of the nose 30, opposite surface 32, as seen at 40 in FIGS. 4 and 5. Slot 40 has a width slightly narrower than the width of insert 54 to provide slot 40 as a guide for an article to be sharpened as tool 10 is run along the article. The sides of guide slot 40 are generally parallel to one another and generally perpendicular to surface 32. The tip 31 of nose 30 is slotted to provide a V-shaped notch 35 to expose the sharpening/deburring edges of inserts 50,52, as seen at 35 in FIGS. 1, 2, and 4. It should be noted that the dotted lines in FIG. 4 indicate the recesses 34,38,38, not the inserts that fit therein.

The sharpening/deburring inserts 50,52,54 are rectangularly shaped flat members made of appropriate material such as tungsten carbide or the like. Each blade has a ground face to be employed in a sharpening/deburring process. With respect to inserts 50,52, the ground faces (52a of insert 52 being shown in FIG. 2) are intersected and overlayed as shown to provide convergent sharpening/deburring working edges 50b,52b that define a V-shaped notch. The ground faces of inserts 50,52 may be beveled at about 5 degrees so that the faces themselves lie in convergent planes. Therefore, the cutting edge of a knife or like device may be rested upon the working edges of inserts 50,52 and tool 10 drawn therealong to sharpen or deburr the cutting edge. The outside from corners of inserts 50,52 may be rounded as shown in FIG. 2.

With respect to insert 54, the outwardly-exposed face 54a is ground to provide working edges at the top and bottom of face 54a. The face 54a of insert 54 is ground such that it tapers inwardly from the edge nearest tip 31 as shown in FIG. 4. Thus, a scissors blade or like device may be rested upon one of the working edges of face 54a and tool 10 drawn therealong to sharpen or deburr the cutting edge. The width of slot 40 is preferably slightly narrower than the width of insert 54, as shown in FIG. 5, so that the cutting edge, to be sharpened, may be guided along the sides of slot 40 away from the side edges of insert 54.

The inserts 50,52,54 are received in overlying abutting relationship and held in such relationship by insert retainer 18. Retainer 18 is somewhat L-shaped and is provided with a securing section 18a, with a hole therein, extending rearwardly from a clamping section 18b at an obtuse angle to coincide with the angle of a mounting surface 60 in the transition section 12c of body 12. Clamping section 18b extends outwardly from the securing section 18a and rests firmly on the outer surface of the outer insert 52 so as to hold the inserts securely in position in their respective recesses. One outer corner of retainer 18, as at 18c, is depressed slightly to engage an edge of insert 52 to prevent insert 52 from sliding sideways or laterally out of its working position. Fastening screw 20 holds retainer 18 in position. Finger guard 14, configured as an arcuate strip of metal or plastic, is adapted to receive the securing section 18a of retainer 18, as by having raised guide edges 14a located on the lower end of the guard for engaging with the sides of the securing section 18a of retainer 18 as shown in FIGS. 1 and 2. A hole is provided in the transition section 12c of body 12, through mounting surface 60, and fitted with a threaded insert 62 as shown in FIG. 3 to receive fastening screw 20. Fastening screw 20 extends through retainer 18 and guard 14 to lock both in their proper positions as shown in the FIGURES. The screw hole through mounting surface 60 is oriented at an incline with respect to surface 32 such that, as fastening screw 20 is threaded into the insert 62, the clamping section 18*b* of retainer 18 will be drawn into firm contact with the outer surface of insert 52, as the retainer 18 and the guard 14 as secured in position.

While the preferred embodiment of the invention has been described herein, variations in the design may be made. The scope of the invention, therefore, is only to be limited by the claims appended hereto.

The embodiments of the invention in which an exclusive property is claimed are defined as follows:

We claim:

1. A tool comprising:

a body having recesses in a first frontal section thereof to receive sharpening and/or deburring inserts and a second section located longitudinally rearwardly of said first frontal section, said recesses, being adapted to receive a first insert member in a generally lateral position with respect to the longitudinal axis of said body that extends transversely to a side of said body, and to receive a second insert member in a generally longitudinal position with respect to the longitudinal axis of said body that extends toward a front edge of said first frontal section, and to receive a third insert member in a generally longitudinal position respect to the longitudinal axis of said body that extends toward the front edge of said first frontal section;

a plurality of sharpening and/or deburring insert members comprising a first insert member having a ground surface providing at least one sharpening and/or deburring edge, said first insert member being positioned within said body recesses such that its ground surface is exposed at one side of said body; a second insert member having a ground surface providing at least one sharpening and/or deburring edge, said second insert member being positioned within said body recesses such that it partially overlays said first insert member in abutting contact therewith and such that its ground surface is oriented toward the outer end of said frontal section at an acute angle with respect to the longitudinal axis of said body; and a third insert member having a ground surface providing at least one sharpening and/or deburring edge, said third insert member being positioned within said body recesses such that it partially overlays said second insert member in abutting contact therewith and such that its ground surface is oriented at an acute angle with respect to the longitudinal axis of said body, the ground surfaces of said second and third insert members being convergent whereby an object to be sharpened or deburred may be inserted between the convergent ground surfaces for sharpening and/or deburring;

said body frontal section recesses and said second and third insert members being so constructed and arranged whereby said body frontal section front edge contains a notch therein that exposes a portion of the convergent ground surfaces of said second and third insert members;

said body frontal section also extending across the front ends of said second and third insert members whereby the front edge of said body frontal section provides a shield limiting sharpening and/or deburring access thereto to said notch; and insert retaining means detachably secured to said body and adapted to contact said third insert member and to apply a sufficient force to that insert member whereby said first, second and third insert members are restrained from movement within said body recesses.

2. The tool of claim 1 wherein said first insert member is positioned crosswise within said body recesses at the base of said body frontal section; and wherein a rearward-most portion of said second insert member rests upon a portion of said first insert member; and wherein said second and third insert members are aligned in scissors-like fashion with respect to one another with said convergent ground surfaces facing toward said body frontal section front edge.

3. The tool of claim 2 wherein said body recesses provide a first transverse channel within which said first insert member is positioned; a second generally longitudinal channel oriented at an acute angle with respect to the longitudinal axis of said body and intersecting said first transverse channel and within which said second insert member is positioned; and a third channel providing a land upon which said third insert member is supported; said first and second channels and said land being so constructed and arranged whereby said third insert member is partially resting upon said land and partially upon said second insert member and said second insert member is partially resting upon said first insert such that clamping force exerted by said insert retaining means on said third insert member is transferred to said second and first insert members.

4. The tool of claim 3 including a guard member is secured to body rearwardly of said body first frontal section so as to extend rearwardly over said body second section.

5. The tool of claim 3 wherein the ground surface of said first insert member is tapered to provide a tapered sharpening and/or deburring edge; and wherein the side of said body that exposes said first insert member is slotted to provide a guideway for an object to be sharpened and/or deburred by contact with said first insert member.

6. A tool comprising:

a body having recesses in a first frontal section thereof to receive sharpening and/or deburring inserts and a second section located longitudinally rearwardly of said first frontal section, said recesses being adapted to receive a first insert member in a generally lateral position with respect to the longitudinal axis of said body that extends transversely to a side of said body, and to receive a second insert member in a generally longitudinal position with respect to the longitudinal axis of said body that extends toward a front edge of said first frontal section, and to receive a third insert member in a generally longitudinal position respect to the longitudinal axis of said body that extends toward the front edge of said first frontal section;

a plurality of sharpening and/or deburring insert members comprising a first insert member having a ground surface providing at least one sharpening and/or deburring edge, said first insert member being positioned within said body recesses such that its ground surface is exposed at one side of said body; a second insert member having a ground surface providing at least one sharpening and/or deburring edge, said second insert member being positioned within said body recesses such that it partially overlays said first insert member in abutting contact therewith and such that its ground surface is oriented toward the outer end of said frontal section at an acute angle with respect to the longitudinal axis of said body; and a third insert member having a ground surface providing at least one sharpening, and/or deburring edge, said third insert member being positioned within said body recesses such that it partially overlays said second insert member in abutting contact therewith and such that its ground surface is oriented at an acute angle with respect to the longitudinal axis of said body, the ground surfaces of said second and third insert members being convergent whereby an object to be sharpened or deburred may be inserted between the convergent ground surfaces for sharpening and/or deburring;

said body frontal section recesses and said second and third insert members being so constructed and arranged whereby said body frontal section front edge contains a notch therein that exposes a portion of the convergent ground surfaces of said second and third insert members;

said body frontal section also extending across the front ends of said second and third insert members whereby the front edge of said body frontal section provides a shield limiting sharpening and/or deburring access thereto to said notch;

insert retaining means detachably secured to said body and adapted to contact said third insert member and to apply a sufficient force to that insert member whereby said first, second and third insert members are restrained from movement within said body recesses;

said first insert member being positioned crosswise within said body recesses at the base of said body frontal section; said second insert member resting upon a portion of said first insert member; and said second and third insert members being aligned in scissors-like fashion with respect to one another with said convergent ground surfaces facing toward said body frontal section front edge;

said body recesses providing a first transverse channel within which said first insert member is positioned; a second generally longitudinal channel oriented at an acute angle with respect to the longitudinal axis of said body and intersecting said first transverse channel and within which said second insert member is positioned; and a third channel providing a land upon which said third insert member is supported; said first and second channels and said land being so constructed and arranged whereby said third insert member is partially resting upon said land and partially upon said second insert member and said second insert member is partially resting upon said first insert such that clamping force exerted by said insert retaining means on said third insert member is transferred to said second and first insert members; and a guard member secured to body rearwardly of said body first frontal section so as to extend rearwardly over said body second section.

7. The tool of claim 6 wherein the ground surface of said first insert member is tapered to provide a tapered sharpening and/or deburring edge; and wherein the side of said body that exposes said first insert member is slotted to provide a guideway for an object to be sharpened and/or deburred by contact with said first insert member.

8. The tool of claim 7 wherein said insert retaining means is slotted to expose an outer end portion of said first insert member to provide access for an object to be sharpened and/or deburred by contact with said first insert member.

* * * * *